US008240668B1

(12) United States Patent
Kimbrell

(10) Patent No.: US 8,240,668 B1
(45) Date of Patent: Aug. 14, 2012

(54) HOLDING SYSTEM FOR PLAYING CARDS

(76) Inventor: Wendi L. Kimbrell, Frisco, TX (US)

( * ) Notice: Subject to any disclaimer, the term of this patent is extended or adjusted under 35 U.S.C. 154(b) by 0 days.

(21) Appl. No.: 13/187,870

(22) Filed: Jul. 21, 2011

(51) Int. Cl.
*A63F 1/10* (2006.01)

(52) U.S. Cl. ..... 273/150

(58) Field of Classification Search ..... 273/150
See application file for complete search history.

(56) References Cited

U.S. PATENT DOCUMENTS

| | | | | |
|---|---|---|---|---|
| 986,665 | A | 3/1911 | Wilder | |
| 1,109,524 | A | 9/1914 | Gessner | |
| 1,828,735 | A | 10/1931 | Givone et al. | |
| 1,996,234 | A * | 4/1935 | Deinstein | 273/150 |
| D178,295 | S | 7/1956 | Lee | |
| D280,112 | S | 8/1985 | Calabro | |
| 4,927,149 | A | 5/1990 | Bull | |
| 5,445,378 | A | 8/1995 | Cook | |
| 5,743,527 | A | 4/1998 | Harley | |
| 6,349,940 | B1 * | 2/2002 | Nimry | 273/150 |

* cited by examiner

*Primary Examiner* — Benjamin Layno

(57) ABSTRACT

A card holding system with a handle having a first, second and base panel, the base panel connected by a bottom edge of the first and second panels, a shaft connected by a top edge of the first and second panels, a plurality of fan pieces sandwiched between the first and second panels, the fan pieces having a first and second end, where the first end is smaller than the second end, the first end is attached to the shaft so the fan pieces can rotate about the shaft and move between at least an open and closed position, in the open position the fan pieces are fanned outwardly from the shaft and handle, in the closed position the fan pieces are positioned in between the panels of the handle, each fan piece having a card slot with a depth on a front surface adapted to hold a playing card.

12 Claims, 4 Drawing Sheets

(ISO Closed View)

(In-use View)

(ISO View)

(ISO Closed View)

(Side View)

(In-use View)

(Cross- Sectional View)

HOLDING SYSTEM FOR PLAYING CARDS

FIELD OF THE INVENTION

The present invention is directed to a device or system for holding a hand of cards.

BACKGROUND OF THE INVENTION

Young children, elderly individuals, or individuals with physical disabilities may have difficulty holding a hand of playing cards. The present invention features a holding system for playing cards. The card holding system of the present invention is a handheld device designed to assist a user when holding playing cards. The system allows the user to see all of his/her cards with one hand.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a card holding system. The system may comprise a handle comprising a first panel, a second panel, and a base panel connecting a bottom edge of the first panel and a bottom edge of the second panel, the first panel and the second panel are spaced a distance apart; a shaft connecting a top edge of the first panel and a top edge of the second panel; a plurality of fan pieces snugly sandwiched between the first panel and the second panel, the fan pieces have a first end and a second end, the first end being smaller than the second end, the first end is attached to the shaft such that the fan pieces can rotate about the shaft, the fan pieces can move between at least an open position and a closed position, wherein in the open position the fan pieces are fanned outwardly from the shaft and handle and in the closed position the fan pieces are positioned in between the panels of the handle; and a card slot disposed on a front surface of each fan piece, the card slot is adapted to accept a playing card, the card slot has a depth.

DESCRIPTION OF PREFERRED EMBODIMENTS

Figure 1:
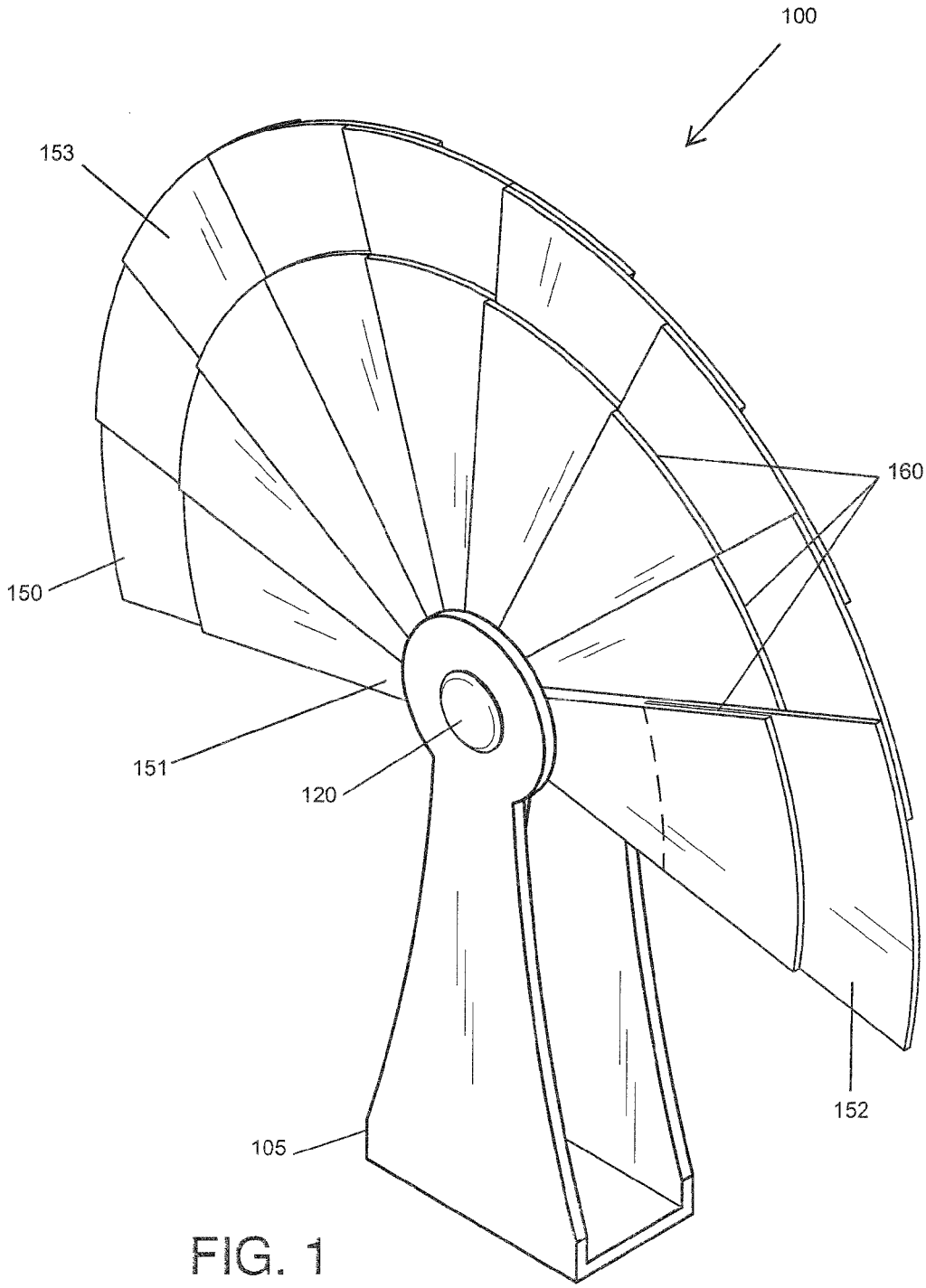
FIG. 1 is a perspective view of the card holding system of the present invention, wherein the fan pieces are in the open position.

Referring now to FIGS. 1-5, the present invention features a card holding system 100. The card holding system 100 of the present invention comprises a handle 105. The handle 105 comprises a first panel 110*a* (e.g., an elongated first panel) and a second panel 110*b* (e.g., an elongated second panel) connected together via a base panel 110*c*. In some embodiments, the base panel 110*c* connects the bottom edge 116*a* of the first panel 110*a* to the bottom edge 116*b* of the second panel 110*b*.

The first panel 110*a* and the second panel 110*b* are spaced a distance apart. In some embodiments, the distance is between about ¼ to ½ inch. In some embodiments, the distance is between about to ¾ inch. In some embodiments, the distance is between about ¾ to 1 inch. In some embodiments, the distance is more than about 1 inch. The handle 110 may be constructed from a variety of materials. For example, in some embodiments, the handle 110 is constructed from a material comprising rubber, plastic, the like, or a combination thereof. The system 100 may be constructed in a variety of styles, colors, and designs.

The handle 105 may be any appropriate shape, for example a shape that provides comfort to a user and allows for maintaining a grip on the handle 105. In some embodiments, the top edges 115 of the panels 110 have a width that is smaller than that of the bottom edges 116. For example, the panels 110 may have a generally triangular shape, the top edges 115 being the smaller ends. A shaft 120 connects the top edge 115*a* of the first panel 110*a* and the top edge 115*b* of the second panel 110*b*.

Figure 2:
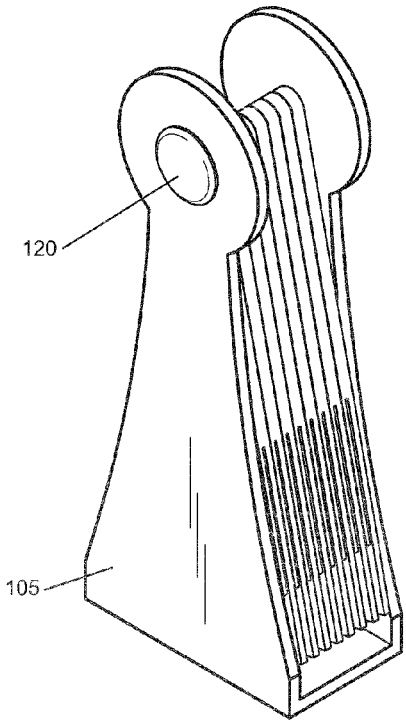
FIG. 2 is a perspective view of the card holding system of the present invention, wherein the fan pieces are in the closed position.
Figure 3:
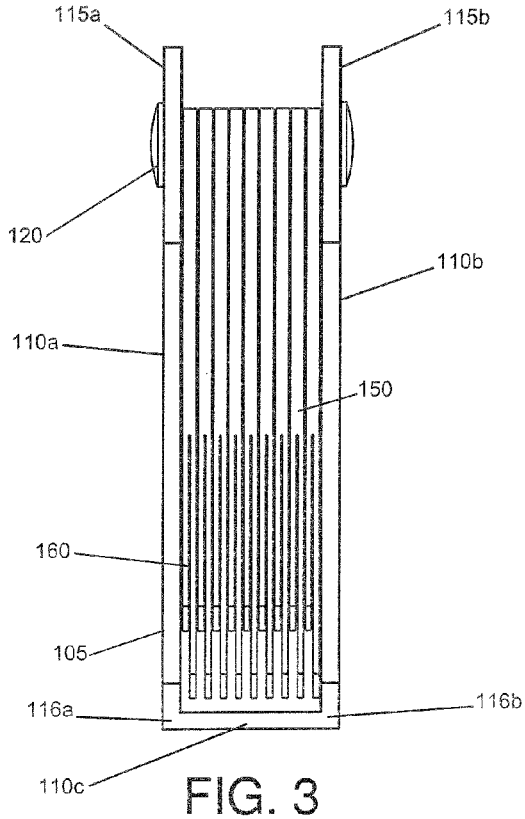
FIG. 3 is a side view of the card holding system of the present invention, wherein the fan pieces are in the closed position.
Figure 4:
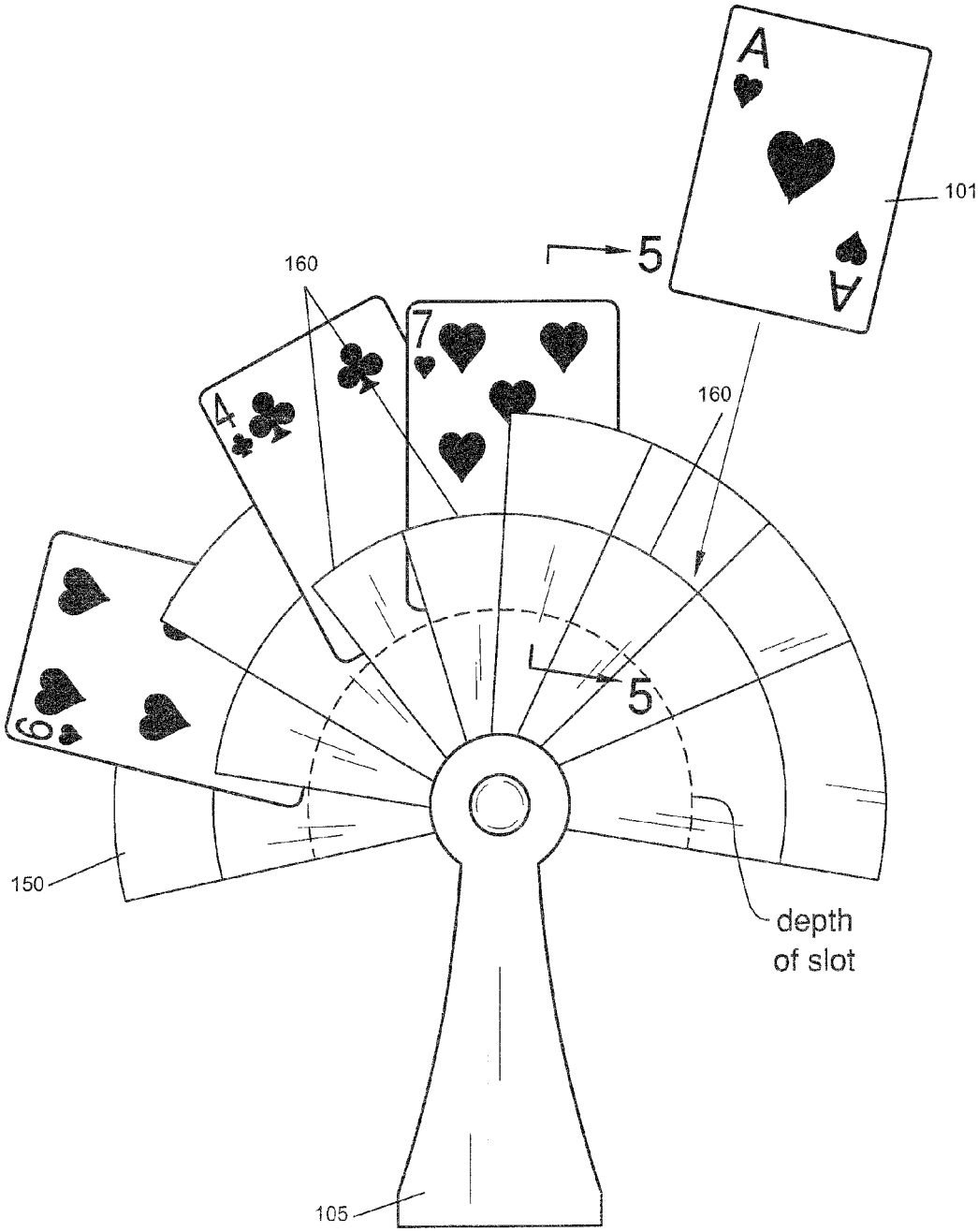
FIG. 4 is an in-use view of the system of the present invention.

Sandwiched between the first panel 110*a* and the second panel 110*b* is a plurality of fan pieces 150 (e.g., a first fan piece, a second fan piece, a third fan piece, a fourth fan piece, a fifth fan piece, a sixth fan piece, a seventh fan piece, an eighth fan piece, a ninth fan piece, a tenth fan piece, etc.). The fan pieces 150 may be tightly or snugly sandwiched between the panels 110. In some embodiments, the fan pieces 150 are generally triangular in shape. The fan pieces 150 have a first end 151 and a second end 152 (the first end 151 being the smaller end). In some embodiments, the second end 152 is curved. The first ends 151 of the fan pieces 150 are attached to the shaft 120 and the second ends 152 of the fan pieces 152 extend outwardly from the shaft 120 (e.g., see FIG. 1). The fan pieces 150 can rotate around the shaft 120. For example, as shown in FIG. 1, the fan pieces 150 can fan outwardly from the shaft 120 and handle 105 (e.g., an open position). As shown in FIG. 2 and FIG. 3, the fan pieces can be positioned in between the panels 110 of the handle 105 (e.g., a closed position). In some embodiments, in the closed position, the playing cards 101 are shielded by the panels 110 of the handle 105 (e.g., to hide the playing cards 101, for example).

Figure 5:
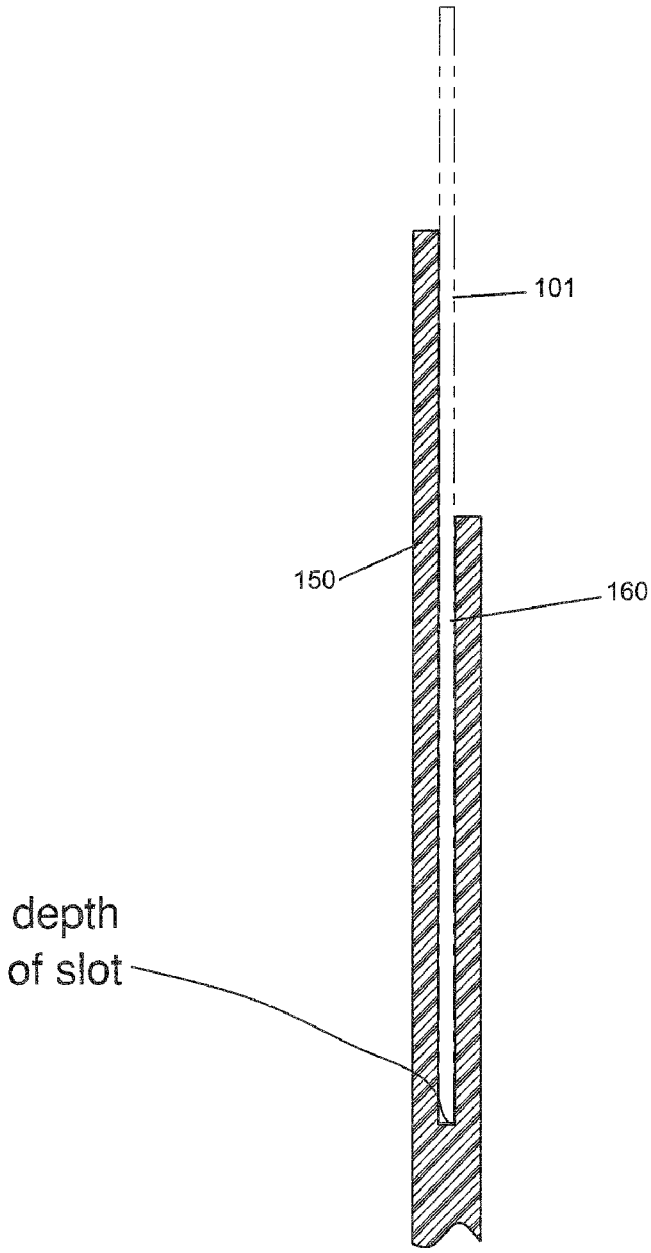
FIG. 5 is a side cross sectional view of the system of FIG. 4.

Each fan piece 150 has a front surface 153 and a back surface. A card slot 160 is disposed on the front surface 153 of each fan piece. The card slot 160 is adapted to accept a playing card 101. FIG. 5 shows a cross sectional view of a fan piece 150. A playing card 101 is engaged in the card slot 160. The card slot 160 has a depth. In some embodiments, the depth is between about ½ to 1 inch. In some embodiments, the depth is between about 1 to 2 inches. In some embodiments the depth is between about 2 to 3 inches.

The system 100 may be constructed in a variety of sizes. For example, in some embodiments, the panels 110 are between about 5 to 7 inches in length as measured from the bottom edge 116 to the top edge 115. In some embodiments, the panels 110 are between about 6 to 8 inches in length as measured from the bottom edge 116 to the top edge 115. The system 100 of the present invention is not limited to the aforementioned dimensions.

Without wishing to limit the present invention to any theory or mechanism, It is believed that the system 100 of the present invention is advantageous because the system 100 comprises a bi-paneled handle 105 (e.g., comprising the first panel 110*a* and the second panel 110*b* separated by a distance) and the fan pieces 150 are rotatably positioned on a shaft 120. The rotation of the fan pieces 150 allows the playing cards 101 and fan pieces 150 to move to various positions (e.g., the open position and the closed position). For example, in the closed position, the panels 110 of the handle 105 can shield the playing cards 101.

As used herein, the term "about" refers to plus or minus 10% of the referenced number. For example, an embodiment wherein the depth is about 1 inch includes a depth that is between 0.9 and 1.1 inches.

In some embodiments, the system 100 comprises at least five fan pieces 150. In some embodiments, the system 100 comprises at least six fan pieces 150. In some embodiments, the system 100 comprises at least eight fan pieces 150.

The disclosures of the following U.S. Patents are incorporated in their entirety by reference herein: U.S. Pat. No. 9,866,65; U.S. Pat. No. 1,109,524; U.S. Pat. No. 1,828,735; U.S. Pat. No. 1,996,234; U.S. Design Pat. No. D178295; U.S. Design Pat. No. D280112; U.S. Pat. No. 4,927,149; U.S. Pat. No. 5,445,378; U.S. Pat. No. 5,743,527; U.S. Pat. No. 6,349,940.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A card holding system 100 comprising:

(a) a handle 105 comprising a first panel 110*a*, a second panel 110*b*, and a base panel 110*c* connecting a bottom edge 116*a* of the first panel and a bottom edge 116*b* of the second panel 110*b*, the first panel 110*a* and the second panel 110*b* are spaced a distance apart;

(b) a shaft 120 connecting a top edge 115*a* of the first panel 110*a* and a top edge 115*b* of the second panel 110*b;*

(c) a plurality of fan pieces 150 snugly sandwiched between the first panel 110*a* and the second panel 110*b*, the fan pieces 150 have a first end 151 and a second end 152, the first end 151 being smaller than the second end 152, the first end 151 is attached to the shaft 120 such that the fan pieces 150 can rotate about the shaft 120, the fan pieces 150 can move between at least an open position and a closed position, wherein in the open position the fan pieces 150 are fanned outwardly from the shaft 120 and handle 105 and in the closed position the fan pieces 150 are positioned in between the panels 110 of the handle 105; and (d) a card slot 160 disposed on a front surface 153 of each fan piece 150, the card slot 160 is adapted to accept a playing card 101, the card slot 160 has a depth;

wherein when the fan pieces 150 are in the closed position, the playing cards 101 are shielded by the panels 110 of the handle 105 to hide the playing cards.

2. The card holding system 100 of claim 1, wherein the distance is between about ¼ to ½ inch.

3. The card holding system 100 of claim 1, wherein the distance is between about ½ to ¾ inch.

4. The card holding system 100 of claim 1, wherein the distance is between about ¾ to 1 inch.

5. The card holding system 100 of claim 1, wherein the handle 105 is constructed from a material comprising rubber, plastic, or a combination thereof.

6. The card holding system 100 of claim 1, wherein the fan pieces 150 are generally triangular in shape.

7. The card holding system 100 of claim 1, wherein the depth is between about ½ to 1 inch.

8. The card holding system 100 of claim 1, wherein the depth is between about 1 to 2 inches.

9. The card holding system 100 of claim 1, wherein the depth is between about 2 to 3 inches.

10. The card holding system 100 of claim 1, wherein the system 100 comprises at least five fan pieces 150.

11. The card holding system 1100 of claim 1, wherein the system 100 comprises at least six fan pieces 150.

12. The card holding system 100 of claim 1, wherein the system 100 comprises at east eight fan pieces 150.

* * * * *